US009048033B2

(12) United States Patent
Borgwardt et al.

(10) Patent No.: US 9,048,033 B2
(45) Date of Patent: Jun. 2, 2015

(54) PRESS-FIT CONTACT ACCOMMODATED IN AN ELECTRICAL DEVICE HOUSING

(71) Applicant: SIEMENS AKTIENGESELLSCHAFT, Munich (DE)

(72) Inventors: Andre Borgwardt, Schoenwalde-Ot Paaren (DE); Alexander Kupsch, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 98 days.

(21) Appl. No.: 13/770,015

(22) Filed: Feb. 19, 2013

(65) Prior Publication Data

US 2013/0213779 A1 Aug. 22, 2013

(30) Foreign Application Priority Data

Feb. 21, 2012 (DE) ..... 10 2012 202 633

(51) Int. Cl.

| | |
|---|---|
| ***H01H 1/06*** | (2006.01) |
| ***H01H 9/02*** | (2006.01) |
| ***H01H 11/06*** | (2006.01) |
| ***H01H 71/08*** | (2006.01) |
| *H01H 1/58* | (2006.01) |

(52) U.S. Cl.

CPC . *H01H 1/06* (2013.01); *H01H 9/02* (2013.01); *H01H 11/06* (2013.01); *H01H 1/58* (2013.01); *H01H 71/08* (2013.01); *H01H 2071/086* (2013.01)

(58) Field of Classification Search

USPC ..... 200/275, 284; 439/907, 109, 874, 877, 439/213

IPC ..... H01H 50/546; H02B 1/20

See application file for complete search history.

(56) References Cited

U.S. PATENT DOCUMENTS

| | | | | |
|---|---|---|---|---|
| 4,152,565 | A * | 5/1979 | Rose | 200/548 |
| 5,828,024 | A | 10/1998 | Takano et al. | |

FOREIGN PATENT DOCUMENTS

| | | | |
|---|---|---|---|
| CN | 1421884 | A | 6/2003 |
| CN | 101681744 | A | 3/2010 |
| DE | 40 21 824 | A1 | 1/1992 |
| DE | 40 21 825 | A1 | 1/1992 |
| DE | 92 03 111 | U1 | 4/1992 |
| DE | 42 07 443 | A1 | 9/1993 |
| DE | 44 37 011 | A1 | 4/1996 |
| DE | 197 46 622 | C2 | 5/2001 |
| DE | 20 2008 011 186 | U1 | 12/2009 |
| WO | WO-2008131900 | A1 | 11/2008 |

OTHER PUBLICATIONS

Chinese Office Action dated Nov. 24, 2014 for corresponding Chinese Application No. 201310175461.8.

* cited by examiner

*Primary Examiner* — Vanessa Girardi

(74) *Attorney, Agent, or Firm* — Harness, Dickey & Pierce, P.L.C.

(57) ABSTRACT

An electrical switch is disclosed, including a switch housing and a busbar routed through a housing opening in the switch housing. In at least one embodiment, a contact element is present for making electrical contact with the busbar, the contact element being clamped in between the busbar and the switch housing in the housing opening.

5 Claims, 2 Drawing Sheets

PRESS-FIT CONTACT ACCOMMODATED IN AN ELECTRICAL DEVICE HOUSING

PRIORITY STATEMENT

The present application hereby claims priority under 35 U.S.C. §119 to German patent application number DE 10 2012 202 633.9 filed Feb. 21, 2012, the entire contents of which are hereby incorporated herein by reference.

FIELD

At least one embodiment of the invention generally relates to an electrical switch.

BACKGROUND

As is known, electrical switches can have a switch housing in which switching components of the electrical switch are accommodated. In order to make electrical contact with the switching components, the switch housing is generally equipped with one or more housing openings through which one or more busbars are routed in order to make contact with the switching components.

SUMMARY

In at least one embodiment, an electrical switch is specified which allows electrical contact to be made with the busbar in a manner which is easy to set up, for example for measurement and/or tripping purposes.

According to at least one embodiment of the invention, a switch is disclosed. Advantageous refinements of the switch according to the invention are specified in the dependent claims.

Accordingly, at least one embodiment of the invention makes provision for a contact element for making electrical contact with the busbar to be present, wherein the contact element is clamped in between the busbar and the switch housing in the housing opening.

At least one embodiment of the invention also relates to a contact element for making electrical contact with a busbar which is routed through a housing opening in a switch housing of an electrical switch. In respect of a contact element of this kind, at least one embodiment of the invention makes provision for the contact element to be formed by a sheet metal strip which is bent at least twice and has at least three sheet metal sections, a first sheet metal section and a second sheet metal section of said three sheet metal sections being arranged parallel to one another and being connected to one another by a connecting section which is oriented at an angle, in particular a right angle, to the first and the second sheet metal section, and a sub-section of the first sheet metal section forms a positive locking section which comprises at least one transversely running positive locking element which extends transverse to the longitudinal direction of the first sheet metal section and can prevent movement of the first sheet metal section along the longitudinal direction of the first sheet metal section within the recess.

At least one embodiment of the invention also relates to a switch housing for an electrical switch having a housing opening through which a busbar of the electrical switch can be routed. In respect of a switch housing of this kind, at least one embodiment of the invention makes provision for a housing wall of the switch housing to have a recess on at least one side, the recess extending as far as the housing opening, wherein the recess has a positive locking section for forming a positive locking connection with a contact element which is inserted into it, and wherein the positive locking section comprises at least one transversely running positive locking recess section which can prevent movement of a contact element which is inserted into the recess in the direction of the housing opening.

At least one embodiment of the invention also relates to a method for making electrical contact with a busbar which is routed through a housing opening in a switch housing. In respect of a method of this kind, the invention makes provision for a contact element for making electrical contact with the busbar to be clamped in between the busbar and the switch housing in the housing opening.

BRIEF DESCRIPTION OF THE DRAWINGS

The invention will be explained in greater detail below with reference to example embodiments; in this case, by way of example.

For the sake of clarity, the same reference symbols are always used for identical or comparable components in the figures.

DETAILED DESCRIPTION OF THE EXAMPLE EMBODIMENTS

Figure 1:
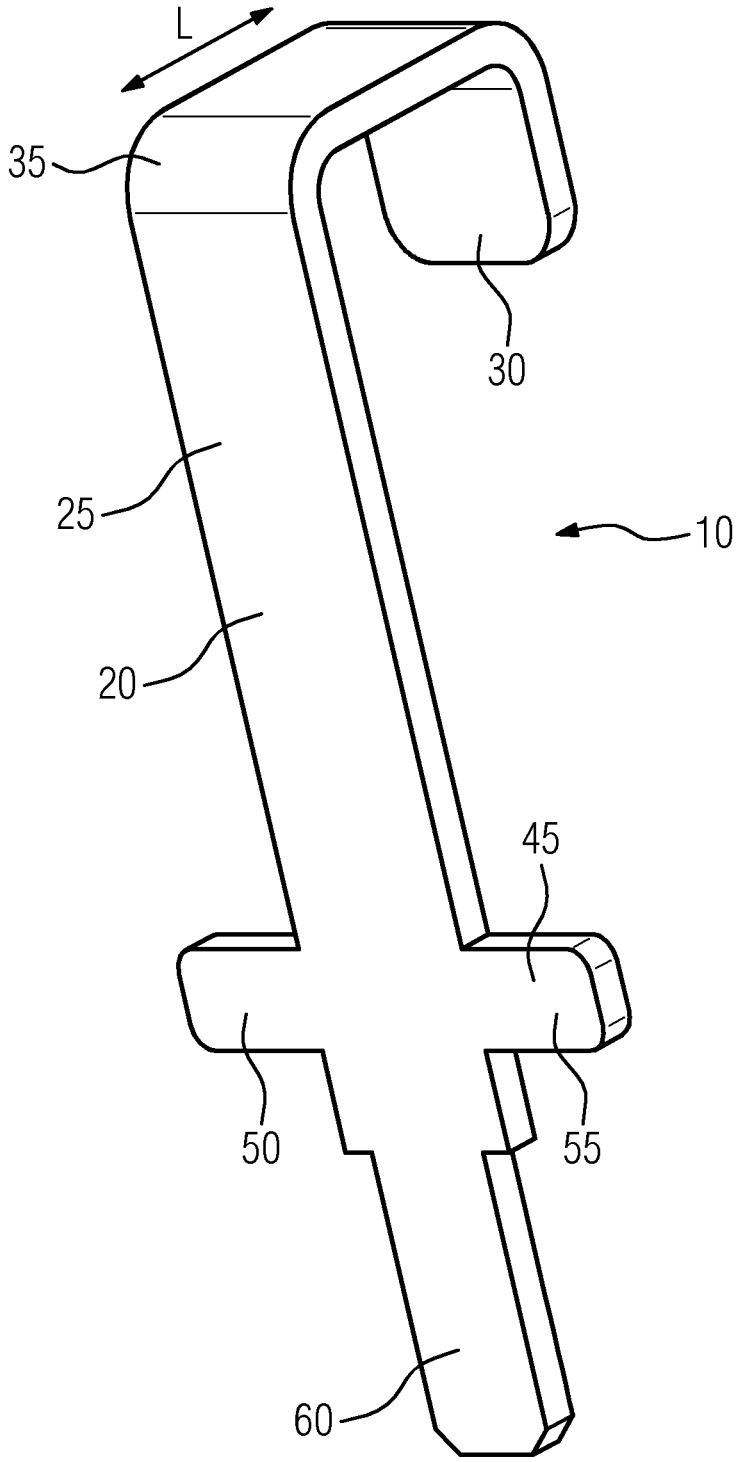
FIG. 1 shows an example embodiment of a contact element according to the invention, which contact element is suitable for making contact with a busbar which is routed through a housing opening in a switch housing of an electrical switch.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Accordingly, at least one embodiment of the invention makes provision for a contact element for making electrical contact with the busbar to be present, wherein the contact element is clamped in between the busbar and the switch housing in the housing opening.

An advantage of the switch according to at least one embodiment of the invention is that it is very easy to fit the contact element for making electrical contact with the busbar. Therefore, at least one embodiment of the invention makes provision for the contact element to be arranged in the region of the housing opening and to be clamped between the busbar and the switch housing. It is therefore not necessary to fasten the contact element by way of fastening screws or the like in the electrical switch according to at least one embodiment of the invention. Mounting only requires the contact element to be placed in the housing opening and then clamped to the busbar.

In respect of the design of the contact element, it is considered to be advantageous when the contact element is formed by a sheet metal strip which is bent at least twice and which has at least three sheet metal sections, a first sheet metal section and a second sheet metal section of the three sheet metal sections being arranged parallel to one another and being connected to one another by a connecting section, wherein the connecting section is oriented at an angle, in particular a right angle, to the first and the second sheet metal section. With this design, the contact element can be produced in a very simple and cost-effective manner; by way of example, it is only necessary to stamp out a sheet metal strip and then bend it only twice.

The contact element can be composed, for example, of spring steel.

In order to ensure that the contact element is firmly seated in the region of the housing opening, it is considered to be advantageous when the first and the second sheet metal section of the sheet metal strip bear against opposite sides of the housing wall, and when the connecting section is routed through the housing opening and is clamped in between the busbar and the switch housing in the housing opening so as to make contact with the busbar. By way of example, the first sheet metal section bears against the inner face of the housing wall and the second sheet metal section bears against the outer face of the housing wall (in each case preferably with a spring action).

In order to prevent the contact element from being able to slip after it is inserted into the housing opening while the busbar is being inserted, it is considered to be advantageous when the housing wall has a recess, which extends as far as the housing opening, on at least one side, the contour of said recess being matched to the contour of the first sheet metal section, and the first sheet metal section is situated in the recess. The contact element can be reliably preliminarily positioned in a particularly simple manner by virtue of the first sheet metal section being arranged in a recess.

The contact element is particularly firmly and reliably seated on the housing wall or in the housing opening when a sub-section of the first sheet metal section forms a positive locking section which is situated in a corresponding positive locking section of the recess so as to form a positive locking connection.

In respect of a positive locking section of this kind, it is considered to be advantageous when the positive locking section of the first sheet metal section comprises at least one transversely running positive locking element which extends transverse to the longitudinal direction of the first sheet metal section and prevents movement of the first sheet metal section along the longitudinal direction of the first sheet metal section within the recess.

The contact element is mounted quickly and at the same time seated particularly firmly when the positive locking section has a cross-shaped contour and comprises at least two transversely running positive locking elements which prevent movement of the first sheet metal section along the longitudinal direction of the first sheet metal section within the recess.

With a view to fastening the contact element in the recess in the housing wall in a positively locking manner, it is further considered to be advantageous when the length of the connecting section between the first sheet metal section and the second sheet metal section is dimensioned in such a way that the first sheet metal section is held with a spring action in the recess in the housing wall by the second sheet metal section.

In order to simplify the connection of a connecting conductor to the contact element, it is considered to be advantageous when the first sheet metal section tapers at its end which is averted from the connecting section and forms a connection section for a cable shoe.

The electrical switch is preferably equipped with a measuring and/or tripping device which is electrically connected to the contact element and is therefore supplied with the voltage which is applied to the busbar.

At least one embodiment of the invention also relates to a contact element for making electrical contact with a busbar which is routed through a housing opening in a switch housing of an electrical switch. In respect of a contact element of this kind, at least one embodiment of the invention makes provision for the contact element to be formed by a sheet metal strip which is bent at least twice and has at least three sheet metal sections, a first sheet metal section and a second sheet metal section of said three sheet metal sections being arranged parallel to one another and being connected to one another by a connecting section which is oriented at an angle, in particular a right angle, to the first and the second sheet metal section, and a sub-section of the first sheet metal section forms a positive locking section which comprises at least one transversely running positive locking element which extends transverse to the longitudinal direction of the first sheet metal section and can prevent movement of the first sheet metal section along the longitudinal direction of the first sheet metal section within the recess.

Reference is made to the above statements in connection with the electrical switch in respect of the advantages of the contact element according to at least one embodiment of the invention since the advantages of the electrical switch substantially correspond to those of the contact element according to at least one embodiment of the invention.

A particularly preferred design of the contact element makes provision for the positive locking section to have a cross-shaped contour and to comprise at least two transversely running positive locking elements which can prevent movement of the first sheet metal section, when positioned within a recess in a housing wall of the switch housing, along the longitudinal direction of the first sheet metal section.

The first sheet metal section preferably tapers at its end which is averted from the connecting section and forms a connection section for a cable shoe.

At least one embodiment of the invention also relates to a switch housing for an electrical switch having a housing opening through which a busbar of the electrical switch can be routed. In respect of a switch housing of this kind, at least one embodiment of the invention makes provision for a housing wall of the switch housing to have a recess on at least one side, the recess extending as far as the housing opening, wherein the recess has a positive locking section for forming a positive locking connection with a contact element which is inserted into it, and wherein the positive locking section comprises at least one transversely running positive locking recess section which can prevent movement of a contact element which is inserted into the recess in the direction of the housing opening.

Reference is made to the above statements in connection with the electrical switch in respect of the advantages of the switch housing according to at least one embodiment of the invention since the advantages of the electrical switch substantially correspond to those of the switch housing according to at least one embodiment of the invention.

A particularly preferred design of the switch housing makes provision for the positive locking section to have a cross-shaped contour and to comprise at least two transversely running positive locking recess sections which can prevent movement of a contact element which is inserted into the recess in the direction of the housing opening.

At least one embodiment of the invention also relates to a method for making electrical contact with a busbar which is routed through a housing opening in a switch housing. In respect of a method of this kind, the invention makes provision for a contact element for making electrical contact with the busbar to be clamped in between the busbar and the switch housing in the housing opening.

Reference is made to the above statements in connection with the electrical switch in respect of the advantages of the method according to at least one embodiment of the invention since the advantages of the electrical switch substantially correspond to those of the method according to at least one embodiment of the invention.

FIG. 1 shows a contact element 10 which is formed by a sheet metal strip 20 which is bent twice and is preferably composed of spring steel. The sheet metal strip 20 comprises a first strip-like sheet metal section 25 which is situated opposite a second, parallel strip-like sheet metal section 30 at least in sections. The first sheet metal section 25 and the second sheet metal section 30 are connected by means of a strip-like connecting section 35 which is arranged perpendicular to the longitudinal direction of the first sheet metal section 25 and also perpendicular to the longitudinal direction of the second sheet metal section 30.

The length L of the connecting section 35 corresponds at least approximately to the depth of a housing opening into which the contact element 20 is inserted for the purpose of making contact with a busbar. The insertion of the contact element 10 into a housing opening of this kind is explained further below in connection with FIG. 2.

FIG. 1 also shows a positive locking section 45 which is formed in the region of the first sheet metal section 25. The positive locking section 45 comprises two positive locking elements 50 and 55 which each extend away from the first sheet metal section 25 in a perpendicular manner—in relation to the longitudinal direction of the first sheet metal section 25. On account of the arrangement and design of the two positive locking elements 50 and 55, the positive locking section 45 has an at least approximately cross-shaped contour in plan view.

As will be explained in greater detail further below, the positive locking section 45 is used to prevent movement of the contact element 10, in particular movement of the first sheet metal section 25, when the contact element 10 is mounted on a housing wall and is inserted into a recess in a housing wall by way of its positive locking section 45.

The contact element 10 also has a connection section 60 which is formed in the region of that end of the first sheet metal section 25 which is averted from the connecting section 35. As shown in FIG. 1, the first sheet metal section 25 tapers, as a result of which a region is created and, for example, a cable shoe—not illustrated further in FIG. 1 for reasons of clarity—can be fitted onto the region.

Figure 2:
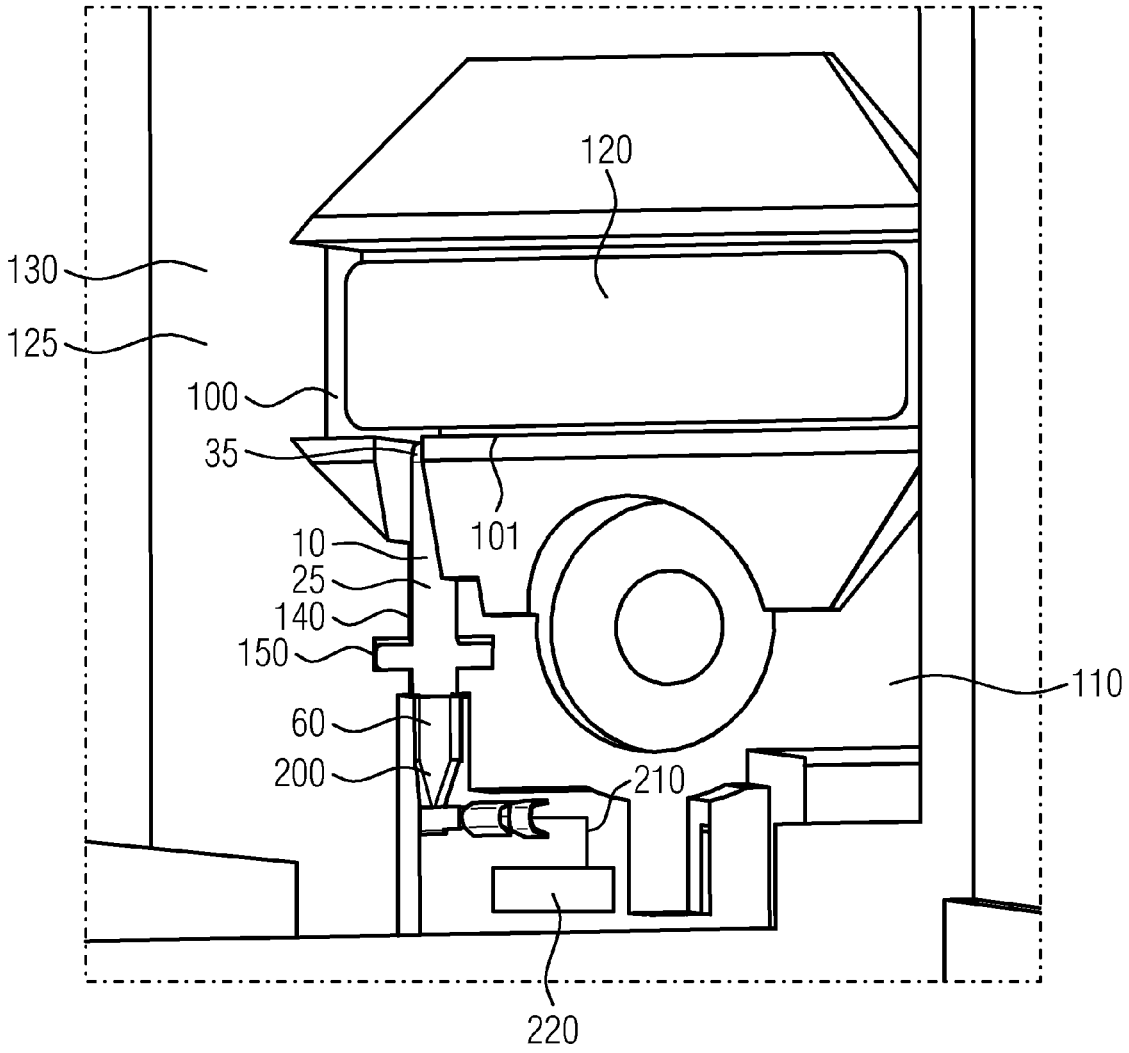
FIG. 2 shows an example embodiment of an electrical switch which is equipped with the contact element according to FIG. 1.

FIG. 2 shows the contact element 10 according to FIG. 1 after it has been inserted into the region of a housing opening 100 in a switch housing 110 of an electrical switch—not illustrated any further. Only the first sheet metal section 25 of the contact element 10 is shown in any detail in FIG. 2. The connecting section 35 extends through the housing opening 100 in the switch housing 110 and is firmly clamped between the housing opening 100 and a busbar 120 which is passed through the housing opening 100. The busbar 120 is merely indicated for reasons of clarity.

FIG. 2 also shows that the housing wall 125 of the switch housing 110 has a recess 140 on its housing inner face 130, the contour of the recess corresponding to the contour of the first sheet metal section 25 of the contact element 10. The recess 140 extends as far as the housing opening 100, with the result that it is possible to fully insert the first sheet metal section 25 of the contact element 10 into the recess 140.

Since the contour of the recess 140 is matched to the contact element 10, it also has a positive locking section 150 with a cross-shaped contour whose shape corresponds to the cross-shaped contour of the positive locking section 45 (cf. FIG. 1) of the first sheet metal section 25. On account of the corresponding shaping, it is no longer possible to move the first sheet metal section 25 or the contact element 10 in the plane parallel to the housing wall 125 after the first sheet metal section 25 has been inserted into the recess 140.

Given suitable dimensioning of the length L of the connecting section 35 (cf. FIG. 1), the first sheet metal section 25 is therefore held in the recess 140 in a positively locking manner, specifically by the second sheet metal section 30 (cf. FIG. 1) which prevents the first sheet metal section 25 from being pulled out or falling out of the recess 140.

In summary, it is therefore possible to insert the contact element 10 into the region of the housing opening and to hold it there in a positively locking manner, without further fastening means being required for holding the contact element 10. After the contact element 10 is positioned in the housing opening 100 and in the recess 140, the busbar 120 can then be routed through the housing opening 100 in order to allow contact to be made with the switching components, which are located in the switch housing, of the electrical switch. In this case, the busbar 120 will rest on the lower face 101 of the housing opening 100 and therefore press the connecting section 35 of the contact element 10 downward. The connecting section 35 and therefore the contact element 10 therefore make contact with the busbar 120 since the connecting section 35 is clamped between the busbar 120 and the lower face 101 of the housing opening 100.

FIG. 2 also shows a cable shoe 200 which is pushed onto the connection section 60 of the contact element 10. A measuring and/or tripping device 220 of the electrical switch is connected to the cable shoe 200 by way of a connecting line 210 which is only indicated. The measuring and/or tripping device 220 is therefore supplied with the respective voltage which is applied to the busbar 120. This allows the measuring and/or tripping device 220 to form and evaluate voltage measurement values which correspond to the voltage which is applied in the busbar 120.

Although the invention has been illustrated and described in detail by preferred example embodiments, the invention is not limited by the disclosed examples and other variations can be derived from the examples by a person skilled in the art without departing from the scope of protection of the invention.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

10 Contact element
20 Sheet metal strip

25 Sheet metal section
30 Sheet metal section
35 Connecting section
45 Positive locking section
50 Positive locking element
55 Positive locking element
60 Connection section
100 Housing opening
101 Lower face
110 Switch housing
120 Busbar
125 Housing wall
130 Housing inner face
140 Recess
150 Positive locking section
200 Cable shoe
210 Connecting line
220 Measuring and/or tripping device
L Length

What is claimed is:

1. A contact element for making electrical contact with a busbar, the contact element comprising:

a sheet metal strip, bent at least twice and including at least three sheet metal sections, a first sheet metal section of the at least three sheet metal sections and a second sheet metal section of the at least three sheet metal sections being arranged parallel to one another and being connected to one another by a connecting section which is oriented at an angle to the first and the second sheet metal section, a sub-section of the first sheet metal section forming a positive locking section which comprises at least one transversely running positive locking element, extending transverse to the longitudinal direction of the first sheet metal section, configured to prevent movement of the first sheet metal section along the longitudinal direction of the first sheet metal section within a recess, wherein the first sheet metal section tapers at an end which is opposite to the connecting section and forms a connection section for a cable shoe.

2. The contact element of claim 1, wherein the positive locking section includes a cross-shaped contour and comprises at least two transversely running positive locking elements configured to prevent movement of the first sheet metal section, when positioned within a recess in a housing wall, along the longitudinal direction of the first sheet metal section.

3. A housing comprising:

a contact element comprising:

a sheet metal strip, bent at least twice and including at least three sheet metal sections, a first sheet metal section of the at least three sheet metal sections and a second sheet metal section of the at least three sheet metal sections being arranged parallel to one another and being connected to one another by a connecting section which is oriented at an angle to the first and the second sheet metal section, a sub-section of the first sheet metal section forming a positive locking section which comprises at least one transversely running positive locking element, extending transverse to the longitudinal direction of the first sheet metal section, configured to prevent movement of the first sheet metal section along the longitudinal direction of the first sheet metal section within a recess, wherein the first sheet metal section tapers at an end which is opposite to the connecting section and forms a connection section for a cable shoe; and a housing wall, including the recess on at least one side, said recess extending as far as a housing opening.

4. The housing of claim 3, wherein the first and the second sheet metal sections of the sheet metal strip respectively bear against opposite sides of the housing wall, and wherein the connecting section is routed through the housing opening and is between the busbar and the housing in the housing opening so as to make contact with the busbar.

5. The housing of claim 3, wherein a contour of said recess is matched to the contour of the first sheet metal section, and wherein the first sheet metal section is situated in the recess.

* * * * *